US009137598B2

(12) United States Patent
Chang et al.

(10) Patent No.: US 9,137,598 B2
(45) Date of Patent: Sep. 15, 2015

(54) HEADPHONE

(71) Applicant: Cheng Uei Precision Industry Co., Ltd., New Taipei (TW)

(72) Inventors: Yu Chao Chang, New Taipei (TW); Tsung Chieh Lee, New Taipei (TW)

(73) Assignee: CHENG UEI PRECISION INDUSTRY CO., LTD., New Taipei (TW)

( * ) Notice: Subject to any disclaimer, the term of this patent is extended or adjusted under 35 U.S.C. 154(b) by 0 days.

(21) Appl. No.: 14/319,838

(22) Filed: Jun. 30, 2014

(65) Prior Publication Data

US 2015/0201268 A1 Jul. 16, 2015

(30) Foreign Application Priority Data

Jan. 10, 2014 (TW) ..... 103200631 U

(51) Int. Cl.
*H04R 1/10* (2006.01)
*H04R 5/033* (2006.01)

(52) U.S. Cl.
CPC ..... *H04R 1/1058* (2013.01); *H04R 1/1041* (2013.01); *H04R 5/033* (2013.01); *H04R 1/1008* (2013.01); *H04R 1/1066* (2013.01); *H04R 5/0335* (2013.01); *H04R 2420/07* (2013.01)

(58) Field of Classification Search
USPC ..... 381/58, 74
See application file for complete search history.

(56) References Cited

U.S. PATENT DOCUMENTS

| | | | | |
|---|---|---|---|---|
| 2,946,860 | A * | 7/1960 | Jansen et al. | 181/129 |
| 2011/0187640 | A1* | 8/2011 | Jacobsen et al. | 345/156 |
| 2014/0016795 | A1* | 1/2014 | Melamed | 381/74 |
| 2014/0064500 | A1* | 3/2014 | Lee | 381/58 |

* cited by examiner

*Primary Examiner* — Davetta W Goins
*Assistant Examiner* — Amir Etesam
(74) *Attorney, Agent, or Firm* — WPAT, P.C.; Anthony King

(57) ABSTRACT

A headphone includes a headphone assembly which includes a head band, two joining structures and two in-ear components pivoted to two ends of the head band by the joining structures, and a sensor module which is disposed in the headphone assembly and includes an upper part, a lower part and a press sensor disposed between the upper part and the lower part and having a sensing face. The upper part and the lower part are designated with inner structures of the head band or the in-ear components. The press sensor detects states of the headphone by judging whether the sensing face is pressed by the upper or lower part by virtue of elastic deformation or movement of the upper part and the lower part at the head band and the joining structure while wearing and removing the headphone. The headphone uses signals from the press sensor to control actions thereof.

9 Claims, 8 Drawing Sheets

HEADPHONE

CROSS-REFERENCE TO RELATED APPLICATION

The present application is based on, and claims priority form, Taiwan Patent Application No. 103200631, filed Jan. 10, 2014, the disclosure of which is hereby incorporated by reference herein in its entirety.

BACKGROUND OF THE INVENTION

1. Field of the Invention

The present invention generally relates to a headphone, and more particularly to a headphone capable of proving intelligent services.

2. The Related Art

For users who are demanding at music quality, headphones are an optical choice to listen to music, because of good sound field and sound insulation effects thereof. However, the headphone needs to be temporarily removed when the user is affected by surrounding environment in the process of listening to music, while the music still keeps running in the meantime. As a result, the music played up situation has changed and the feeling of user for music is inevitably influenced after the headphone is worn by the user again.

Therefore, some users will take off the headphones after pausing the music. So although the music is still interrupted, but after the headphone is worn again, the user can also recall the anterior period of the feeling of the music and keep up with the mood before pausing the music, and then continue to enjoy the music down the mood. However, the user has not always remembered to pause the music before every time removing the headphone. As a result, the feeling of user for music will be still influenced after the headphone is worn by the user again if the user forgets pausing the music.

With the development of electronic technology, electronic products having intelligent services are more and more popular, such as smart phones and smart appliances. They can automatically provide convenient services for the users depending on the demands of the users. In view of this, for solving the foregoing problems, an improved headphone capable of providing intelligent services is required.

SUMMARY OF THE INVENTION

An object of the present invention is to provide a headphone capable of providing intelligent services. The headphone includes a headphone assembly and a sensor module disposed in the headphone assembly and coupled with the headphone assembly. The headphone assembly includes a head band, a pair of in-ear components and a pair of joining structures. The in-ear components are pivoted to two distal ends of the head band by the joining structures respectively. The sensor module includes an upper part, a lower part disposed apart opposite the upper part and a press sensor disposed between the upper part and the lower part. The press sensor has a sensing face. The upper part and the lower part are designated with inner structures of the head band or the in-ear components of the headphone assembly. The press sensor detects using states of the headphone by judging whether the sensing face thereof is pressed by the upper part or the lower part by virtue of elastic deformation or movement of the upper part and the lower part at the head band and the joining structure of the headphone assembly while wearing and taking off the headphone. Then the headphone uses signals from the press sensor to control actions thereof.

As described above, the headphone of the present invention utilizes the sensor module to detect whether the headphone is worn by the user, and then controls the actions of the headphone, such as music pause/start or power on/off. So the headphone of the present invention could provide the intelligent services for the users.

BRIEF DESCRIPTION OF THE DRAWINGS

The present invention will be apparent to those skilled in the art by reading the following description, with reference to the attached drawings, in which.

DETAILED DESCRIPTION OF THE PREFERRED EMBODIMENT

Figure 1:
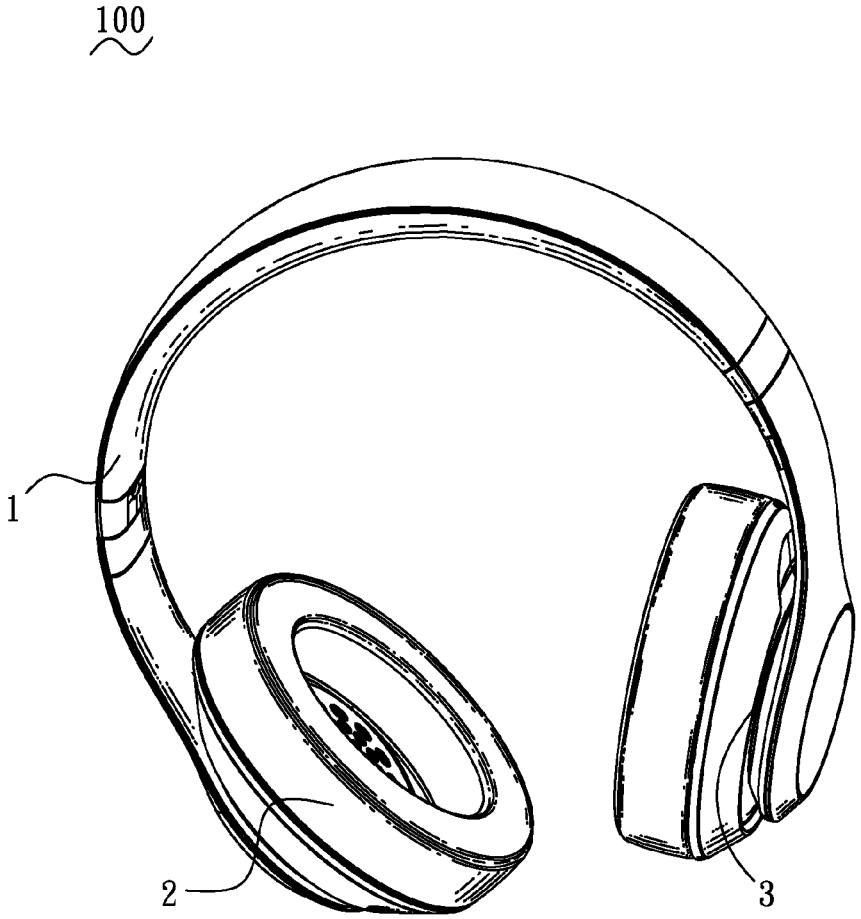
FIG. 1 is a perspective view of a headphone according to the present invention.

Referring to FIG. 1, a headphone 100 according to the present invention is shown and can provide intelligent services for users. The principle of the headphone 100 providing the intelligent services is by sensing structure changes of the headphone 100 to detect whether the headphone 100 is used. In detail, the headphone 100 has an elastic expansion for conforming to the head of the user during it is worn by the user. So elastic deformation will occur at a head band 1 and a joining structure 3 of the headphone 100 while wear and take off the headphone 100. The headphone 100 of the present invention detects using states thereof by sensing the foregoing elastic deformation, and then automatically switches the headphone 100 according to the using states.

Figure 2:
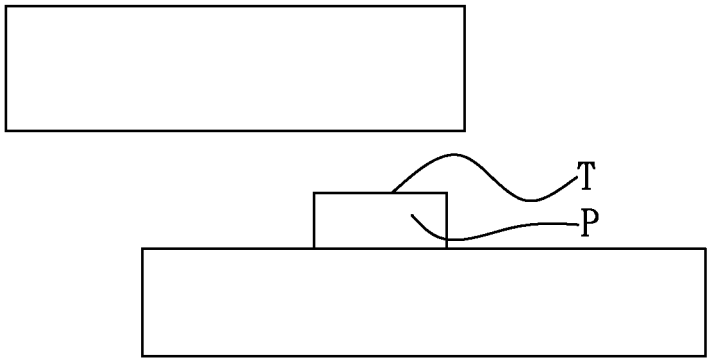
FIG. 2 is a simplified schematic diagram of a sensor module of the headphone of FIG. 1.

Referring to FIG. 1 and FIG. 2, the headphone 100 includes a headphone assembly and a sensor module which is disposed in the headphone assembly and coupled with the headphone assembly, wherein the sensor module is used to sense the foregoing elastic deformation of the headphone 100. The headphone assembly includes a head band 1, a pair of in-ear components 2 and a pair of joining structures 3, wherein the in-ear components 2 are pivoted to two distal ends of the head band 1 by the joining structures 3 respectively.

The sensor module includes an upper part (not labeled), a lower part (not labeled) disposed apart opposite the upper part, and a press sensor P disposed between the upper part and the lower part, wherein the upper part and the lower part can be designated with parts structure of the headphone assembly. The press sensor P has a sensing face T. For using the press sensor P to detect the using states of the headphone 100, the sensing face T of the press sensor P apart faces the upper part or the lower part when the headphone 100 is not in use (namely the headphone 100 is not worn on the user's head). After the headphone 100 has the elastic expansion for being worn by the user, the upper part and the lower part stay close to each other to contact the sensing face T and press the press sensor P.

Figure 3:
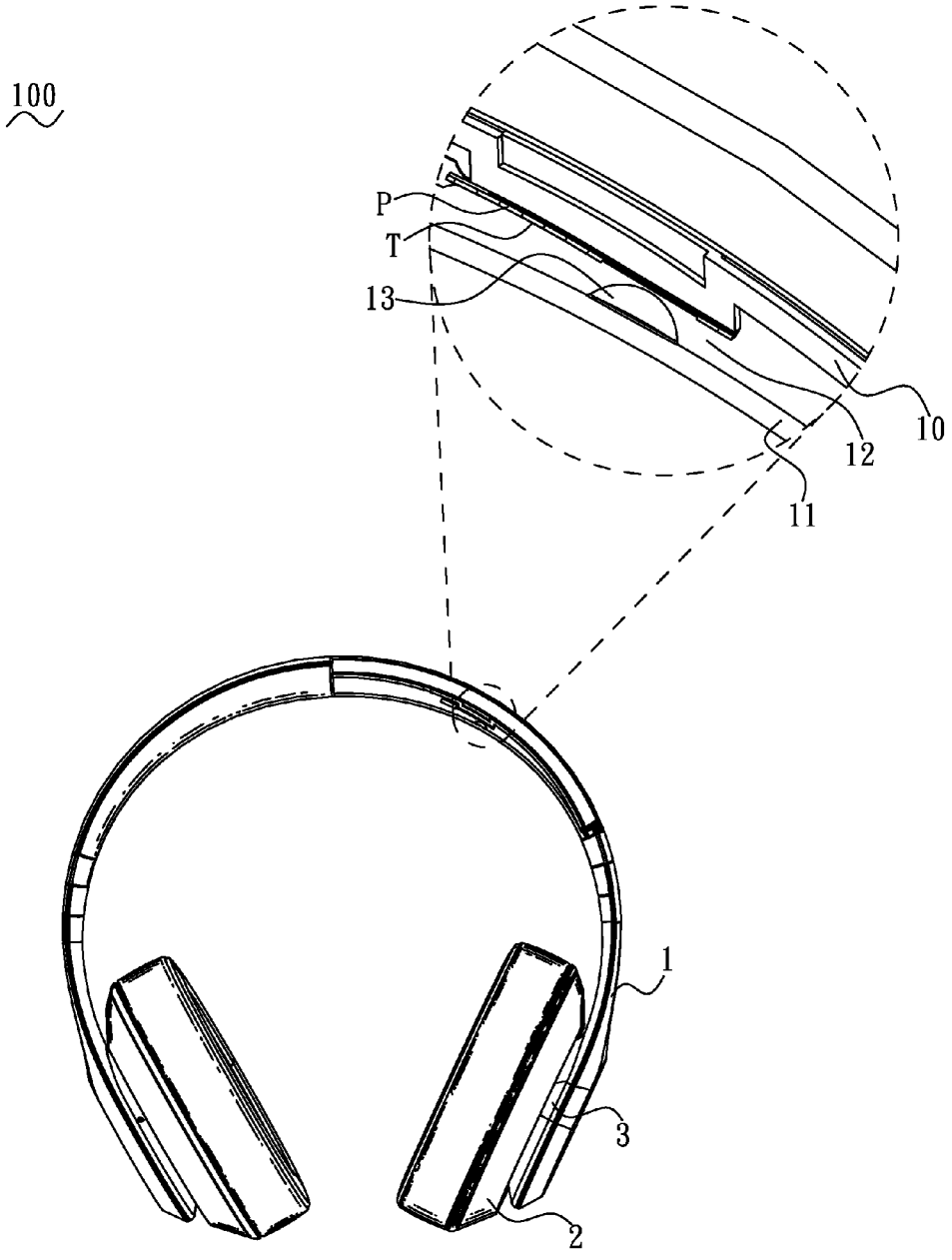
FIG. 3 is a partial section view of one embodiment of the headphone of FIG. 1, which shows the sensor module of FIG. 2 is located in a head band of the headphone.
Figure 4:
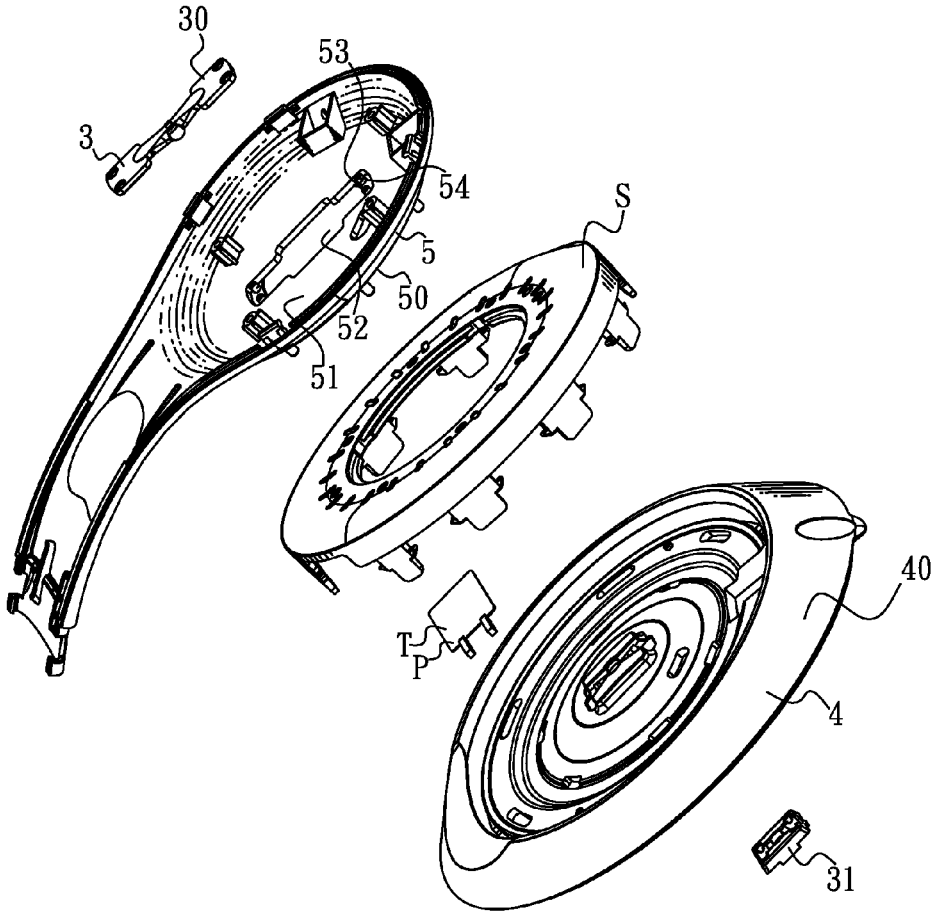
FIG. 4 is an exploded view of another embodiment showing that the sensor module of FIG. 2 is located in a joining structure of the headphone.
Figure 5:
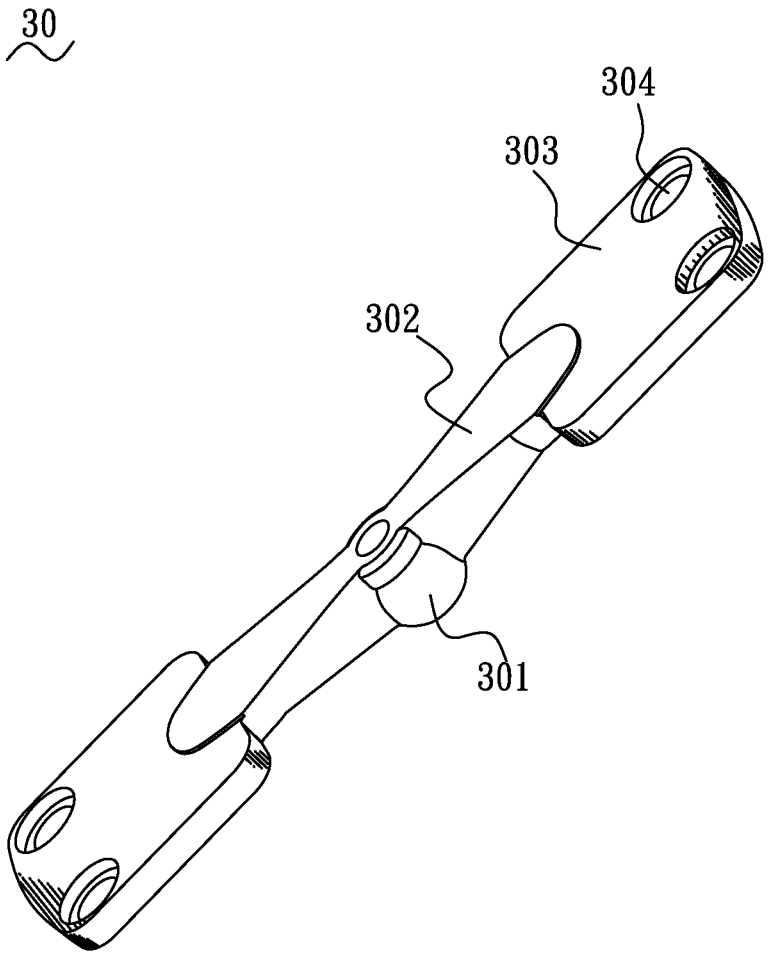
FIG. 5 is a perspective view of a press plate of the joining structure shown in FIG. 4.
Figure 6:
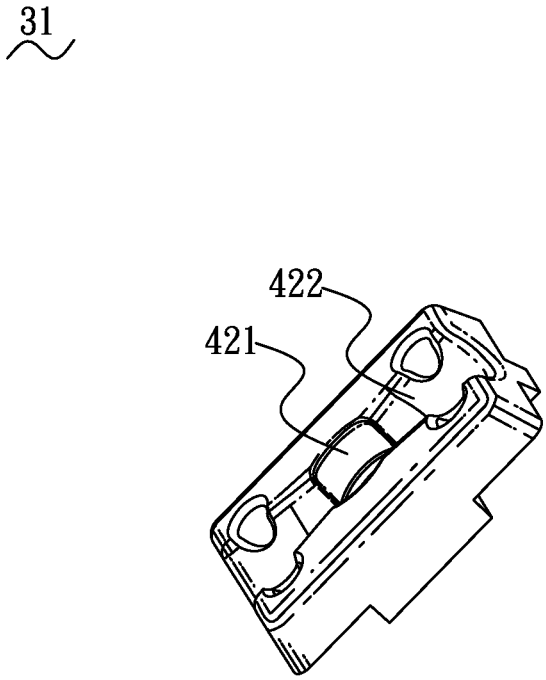
FIG. 6 is a perspective view of a joint substrate of the joining structure shown in FIG. 4.
Figure 7:
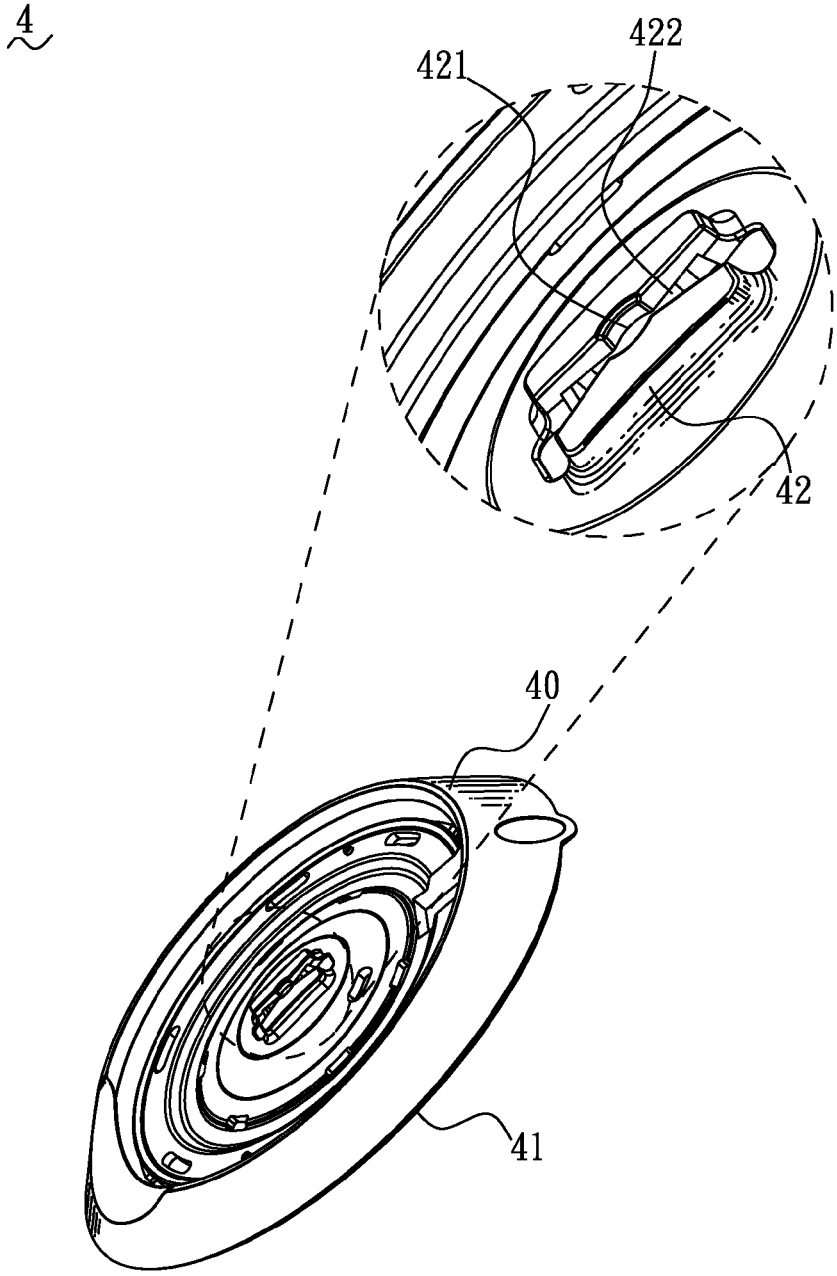
FIG. 7 is a partial enlarged view of a front cover of the sensor module shown in FIG. 4.

Referring to FIG. 3, it shows one embodiment of the headphone 100, wherein the sensor module is located in the head band 1. In this embodiment, the headphone 100 uses the elasticity of the head band 1 to produce the desired displacement of the upper part and the lower part of the sensor module so as to contact the sensing face T and press the press sensor P. The head band 1 is substantially of U shape, and has a flexible headband 10 acted as the upper part of the sensor module, and a headband cushion 11 acted as the lower part of the sensor module. The flexible headband 10 is located above the headband cushion 11, and there is an interval 12 between the flexible headband 10 and the headband cushion 11. The press sensor P is disposed on the inner side of the flexible headband 10 in the interval 12, and the sensing face T thereof faces the headband cushion 11. The inner side of the headband cushion 11 is equipped with a contact part 13 located in the interval 12 and facing the press sensor P. When the headphone 100 is not worn by the user, a distance is between the contact part 13 and the sensing face T of the headband cushion 11. The headband cushion 11 is made from soft material such as rubber, and the contact part 13 is but not limited to a domed embossment or a plane structure.

In other embodiments, the press sensor P is also able to be disposed on the inner side of the headband cushion 11 in the interval 12, and the contact part 13 is correspondingly disposed on the inner side of the flexible headband 10 and faces the sensing face T of the sensor module P.

It is known that if two different lengths of strip-shaped parts want to be connected end-to-end, the longer part will be bent to realize the same distance between the two distal ends thereof as between the two distal ends of the shorter part. After the two parts are connected together, an interval appears between the two parts and the size of the interval could be changed by regulating bending of the two parts. Therefore, the headphone 100 could use the elasticity of the head band 1 to change the size of the interval 12 between the flexible headband 10 and the headband cushion 11 so as to touch or disconnect from the sensing face T of the press sensor P.

After the flexible headband 10 is elastically expanded, the headband cushion 11 is stretched by traction force of the two distal ends of the flexible headband 10 so as to make the contact part 13 touch the sensing face T, so that a contact signal is gotten. Or after the headphone 100 is worn by the user, the headband cushion 11 abuts against the user's head and the contact part 13 is directly pressed to touch the sensing face T so as to get the contact signal.

Referring to FIGS. 4-7, they show another embodiment of the headphone 100, wherein the sensor module is located in the joining structure 3. The joining structure 3 is pivoted between the head band 1 and the in-ear component 2 to achieve a relative movement between the in-ear component 2 and the head band 1. In this embodiment, the headphone 100 uses the relative movement at the joining structure 3 to touch the sensing face T so as to get the contact signal from the press sensor P. A cover assembly at the connection of the head band 1 and the in-ear component 2 includes a front cover 4 and a rear cover 5 which are acted as the upper part and the lower part of the sensor module respectively. The front cover 4 and the rear cover 5 are coupled with each other and are pivoted together by the joining structure 3, and the relative movement is realized between the front cover 4 and the rear cover 5. The front cover 4 and the rear cover 5 have two face-to-face faces thereof designated as a first face 40 and a third face 50 respectively, and two opposite faces thereof designated as a second face 41 and a fourth face 51 respectively.

The front cover 4 has a rectangular positioning portion 42 located in the middle thereof and protruded beyond the first face 40. The joining structure 3 includes a press plate 30 and a joint substrate 31. The press plate 30 has a rotor 301, at least one cantilever 302 extending from an outside of the rotor 301 along a direction perpendicular to the movement axis of the rotor 301, and a wing plate 303 extending from a distal end of the cantilever 302. A pair of guide holes 304 is apart opened in the wing plate 303.

The joint substrate 31 is assembled in the positioning portion 42 of the front cover 4 through the second face 41. The joint substrate 31 and the front cover 4 together define a receiving chamber 421 penetrating through the middles of the joint substrate 31 and the positioning portion 42. At least one side of the receiving chamber 421 is further spread outward along a direction perpendicular to the movement axis of the rotor 301 to form a receiving groove 422 corresponding to the cantilever 302 of the press plate 30. The receiving groove 422 is opened in the top of the joint substrate 31 and penetrates upward through the first face 40 and sideward through two sides of the joint substrate 31 and the positioning portion 42 along the extending direction thereof.

The rear cover 5 defines a through hole 52 opened in a middle thereof through the third face 50 and the fourth face 51 and corresponding to the positioning portion 42 of the front cover 4. A pair of receiving fillisters 53 is opened at two sides of the through hole 52 through the fourth face 51 and corresponds to the wing plates 303 of the press plate 30, and a pair of guide pillars 54 is protruded on an inner sidewall of each receiving fillister 53 and corresponds to the guide holes 304 of the wing plate 303.

The press plate 30 is assembled in the through hole 52 of the rear cover 5 via the fourth face 51. The wing plate 303 is located in the receiving fillister 53 and the guide pillars 54 are inserted in the guide holes 304. The rear cover 5 is covered with the front cover 4 with the first face 40 being against the third face 50. The positioning portion 42 stretches in the through hole 52 to receive the rotor 301 of the press plate 30 in the receiving chamber 421 and locate the cantilever 302 in the receiving groove 422. Particularly, between the cantilever 302 and the receiving groove 422 and between the wing plate 303 and the receiving fillister 53 a space must be retained for the press plate 30 activity. The rotor 301 of the press plate 30 is locked to the joint substrate 31 and the wing plate 303 is restricted by the receiving fillister 53, so as to cover the front cover 4 onto the rear cover 5. An elastic part S is disposed between the front cover 4 and the rear cover 5 for regulating relative angle and providing recoil stress between the front cover 4 and the rear cover 5. The elastic part S can be a spring, a gum-elastic, an elastic slice or other similar elements having elasticity along the movement axis of the front cover 4 with respect to the rear cover 5.

The cooperation of the rotor 301 of the press plate 30 and the receiving chamber 421 of the joint substrate 31 is for realizing the steady relative movement of the front cover 4 and the rear cover 5. The joint substrate 31 can be of spheroidal shape, of hemispheroidal shape, or other shapes capable of realizing the pivotal movement between the front cover 4 and the rear cover 5. In other embodiments, the joint substrate 31 and the positioning portion 42 of the front cover 4 can be molded in one.

The press sensor P is disposed, but not limited to, on the front cover 4, as long as the sensing face T stretches between the front cover 4 and the rear cover 5 and faces the press plate 30.

According to the foregoing embodiment, it is known that the contact signal from the press sensor P is gotten by the relative movement of the front cover 4 and the rear cover 5 at the joining structure 3.

In the above-mentioned embodiments, the contact signals are sent to a transmitter-receiver device (not shown) by a control device (not shown) so as to control actions of the headphone 100, such as music pause/start or power on/off.

Figure 8:
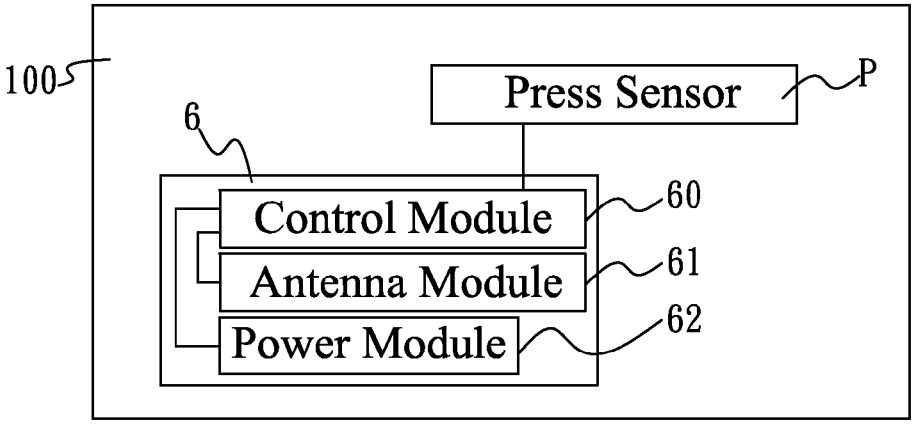
FIG. 8 is another one embodiment, wherein the headphone of the present invention is applied to a wireless headphone.

Referring to FIG. 8, it shows the headphone 100 of the present invention is applied to a wireless headphone. In this embodiment, the headphone 100 further includes a wireless transmitter-receiver device 6 for wirelessly receiving and transmitting the signals from the press sensor P. The wireless transmitter-receiver device 6 includes a control module 60, an antenna module 61 and a power module 62. The control module 60 is coupled with the press sensor P, the antenna module 61 and the power module 62, and utilizes power supply from the power module 62 and signals from the antenna module 61 to control the headphone assembly of the headphone 100. The control module 60 further controls the actions of the headphone 100, such as music pause/start or power on/off, after receiving the signals from the press sensor P. In this embodiment, the antenna module 61 is preferentially a Bluetooth antenna module.

In this invention, the press sensor P can be a piezoresistive press sensor, a ceramic press sensor, a diffused silicon press sensor, a sapphire press sensor or a sensor capable of producing digital signals through contact action.

In other embodiments, the press sensor P can also work to detect the using states of the headphone 100 as follows. When the headphone 100 is not in use (namely the headphone 100 is not worn on the user's head), the sensing face T of the press sensor P is pressed by the inner parts structure of the headphone assembly. After the headphone 100 has the elastic expansion for being worn by the user, the inner parts structure of the headphone assembly generates deformation or movement to make the sensing face T of the press sensor P apart from the inner parts structure of the headphone assembly.

As described above, the headphone 100 of the present invention utilizes the sensor module to detect whether the headphone 100 is worn by the user, and then controls the actions of the headphone 100, such as music pause/start or power on/off. So the headphone 100 of the present invention could provide the intelligent services for the users.

What is claimed is:

1. A headphone, comprising:

a headphone assembly including a head band, a pair of in-ear components and a pair of joining structures, the in-ear components being pivoted to two distal ends of the head band by the joining structures respectively; and a sensor module disposed in the headphone assembly and coupled with the headphone assembly, the sensor module including an upper part, a lower part disposed apart opposite the upper part and a press sensor disposed between the upper part and the lower part, the press sensor having a sensing face, wherein the upper part and the lower part are designated with inner structures of the head band or the in-ear components of the headphone assembly, the press sensor detects using states of the headphone by judging whether the sensing face thereof is pressed by the upper part or the lower part by virtue of elastic deformation or movement of the upper part and the lower part at the head band and the joining structure of the headphone assembly while wearing and taking off the headphone, then the headphone uses signals from the press sensor to control actions thereof, wherein the sensor module is located in the joining structure of the headphone assembly, a cover assembly at the connection of the head band and the in-ear component includes a front cover and a rear cover which are acted as the upper part and the lower part of the sensor module respectively, the front cover and the rear cover are coupled with each other and are pivoted together by the joining structure to realize a relative movement therebetween, the press sensor is disposed with the sensing face stretching between the front cover and the rear cover for touching or disconnecting from the front cover or the rear cover by virtue of the relative movement of the front cover and the rear cover.

2. The headphone as claimed in claim 1, wherein an elastic part is disposed between the front cover and the rear cover for regulating relative angle and providing recoil stress between the front cover and the rear cover.

3. The headphone as claimed in claim 2, wherein the elastic part can be a spring, a gum-elastic, an elastic slice or other similar elements having elasticity along the movement axis of the front cover with respect to the rear cover.

4. The headphone as claimed in claim 1, wherein the front cover and the rear cover have two face-to-face faces thereof designated as a first face and a third face respectively, and two opposite faces thereof designated as a second face and a fourth face respectively, the front cover has a positioning portion protruded beyond the first face, the joining structure includes a press plate and a joint substrate, the press plate has a rotor and at least one cantilever extending from an outside of the rotor along a direction perpendicular to the movement axis of the rotor, the joint substrate is assembled in the positioning portion of the front cover through the second face, the joint substrate and the front cover together define a receiving chamber penetrating through the middles of the joint substrate and the positioning portion, at least one side of the receiving chamber is further spread outward to form a receiving groove corresponding to the cantilever of the press plate, the rear cover defines a through hole corresponding to the positioning portion of the front cover, the press plate is assembled in the through hole of the rear cover, the rear cover is covered with the front cover with the first face being against the third face, the positioning portion stretches in the through hole to receive the rotor of the press plate in the receiving chamber and locate the cantilever in the receiving groove with a space being retained between the cantilever and the receiving groove.

5. The headphone as claimed in claim 4, wherein a distal end of the cantilever extends to form a wing plate, a pair of receiving fillisters is opened at two sides of the through hole through the fourth face and corresponds to the wing plates of the press plate, the wing plate is located in the receiving fillister, a space is further retained between the wing plate and the receiving fillister.

6. The headphone as claimed in claim 5, wherein a pair of guide holes is apart opened in the wing plate, and a pair of guide pillars is protruded on an inner sidewall of each receiving fillister and corresponds to the guide holes of the wing plate, the guide pillars are inserted in the guide holes.

7. The headphone as claimed in claim 4, wherein the joint substrate and the positioning portion of the front cover can be molded in one.

8. The headphone as claimed in claim 1, further comprising a wireless transmitter-receiver device for wirelessly receiving and transmitting the signals from the press sensor, the wireless transmitter-receiver device includes a control module, an antenna module and a power module, the control module is coupled with the press sensor, the antenna module and the power module, the control module controls the actions of the headphone after receiving the signals from the press sensor.

9. The headphone as claimed in claim 1, wherein the press sensor can be a piezoresistive press sensor, a ceramic press sensor, a diffused silicon press sensor, a sapphire press sensor or a sensor capable of producing digital signals through touch action.

* * * * *